US006174191B1

(12) United States Patent
Maue et al.

(10) Patent No.: US 6,174,191 B1
(45) Date of Patent: Jan. 16, 2001

(54) ELECTRIC PIN-AND-SOCKET COUPLER

(75) Inventors: Hans-Heinrich Maue, Bietigheim-Bissingen; Wolfgang Staudenmaier, Weinstadt; Roman Hoernle, Weissach, all of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/245,021

(22) Filed: Feb. 5, 1999

(30) Foreign Application Priority Data

Feb. 9, 1998 (DE) ..... 298 02 142 U

(51) Int. Cl.[7] ..... H01R 13/629
(52) U.S. Cl. ..... 439/372
(58) Field of Search ..... 439/372, 345, 439/347, 152, 153, 157, 160, 266, 260–270

(56) References Cited

U.S. PATENT DOCUMENTS 4,981,440 * 1/1991 Werner et al. ..... 439/266
5,395,258 * 3/1995 Okumura et al. ..... 439/157
5,681,175 * 10/1997 Busse et al. ..... 439/157

OTHER PUBLICATIONS

KET Product Guide, Oct. 1994, p. 59.

* cited by examiner

*Primary Examiner*—Steven L. Stephan
*Assistant Examiner*—Eugene G. Byrd
(74) *Attorney, Agent, or Firm*—Kenyon & Kenyon

(57) ABSTRACT

In an electric pin-and-socket coupler, between a first connector receiving a wiring harness and a second connector as a plug receiver on a stationary control unit, an auxiliary device having a lever as a manipulating part for closing or opening the pin-and-socket coupler locks securely in the closed position of the pin-and-socket coupler regardless of the feeding direction of the wiring harness. To that end, attached to the first connector is a latching member which bears two latching elements, of which the second latching element, after a displacement of the latching member transversely to the moving direction of the lever, comes into its grasping area, such that it forms an end stop for the lever. The electric pin-and-socket coupler is used in particular in the automobile industry.

3 Claims, 2 Drawing Sheets

ELECTRIC PIN-AND-SOCKET COUPLER

BACKGROUND INFORMATION

A pin-and-socket coupler is made up of a first connector, e.g., a movable wiring-harness plug, and a second connector, e.g., a plug receiver on a stationary control unit in a motor vehicle.

The two connectors are able to be reversibly coupled to one another, the closing and opening forces being applied by an auxiliary device because of the multitude of contact points. The auxiliary device has a swivelling locking lever as the manipulating part which is preferably supported on the first connector.

A pin-and-socket coupler designed in such a manner is described, for example, by the KET Product Guide, October 1994, page 59, under the designations MG640732 and MG650740 of the Korea Electric Terminal Co., Ltd.

In this pin-and-socket coupler, the block-shaped first connector features the locking lever. The housing of the first connector, which is grasped by hand for feeding the wiring-harness plug through the receiver and is designated as a gripping shell, is designed in one piece, and is open at a lower side for accessibility of its contact elements arranged in rows in a contact carrier.

At one end wall, the gripping shell has a stub (connecting piece) for introducing a wiring harness, and at the side walls adjacent to this end wall, has bearings for the U-shaped locking lever which, when swivelling, slides, with two limbs that are parallel to one another and connected by a crosspiece, along the side walls.

When using this pin-and-socket coupler under restricted spatial conditions, e.g., in a motor vehicle, it can occur that the wiring harness is admitted from a side facing away from the connecting piece, so that the necessary rerouting of the wiring harness may impede the handling of the locking lever which, in the limit positions of its operation, with the crosspiece as the end stop, lies in an open position against the wiring harness, and in a closed position against a top surface of the gripping shell.

To safeguard the closed position of the locking lever, each of the limbs is reversibly locked in place behind allocated catching elements on the side walls of the gripping shell.

It is known as such in the case of a wiring-harness plug, to vary the inlet for the wiring harness in such a way that the wiring harness can be admitted from different directions.

If, to that end, the gripping shell has a two-part design, having a base on which the locking lever is supported, and having a cover which is able to be placed interchangeably (from different directions) on the base and on which the stub is integrally molded, then it can occur that, due to an asymmetrical formation of the cover as a result of the stub attached on one side, the top surface is only available in one case as an end stop for the crosspiece to delimit the closed position of the locking lever, and given a cover which is mounted interchangeably, this end stop is missing.

On the other hand, no end stops can be mounted as substitute on the side walls of the base following the catching elements. This can be traced back to the fact that, given a two-piece gripping shell, for reasons from a standpoint of production engineering, the contact elements are inserted, with the cover removed, directly from the base top-side, upon which the cover is also placed.

However, to that end, it is necessary to swivel the locking lever into a so-called assembling position which lies outside of the swivelling area for locking or releasing the two connectors, and which allows unimpeded access to the top side of the base.

It is undesirable that swivelling the locking lever into the assembling position, which corresponds to the state at time of supply at the outfitter, would not be possible with fixed end stops on the base of the gripping shell.

SUMMARY OF THE INVENTION

The pin-and-socket coupler of the present invention has the advantage that the previously mentioned inaccessibility is avoided to a satisfactory extent.

To that end, one of the two connectors which form the electric pin-and-socket coupler has a latching member as part of a latching device, two latching elements being formed on the latching member. In an initial position, a counter-latching means, which is part of an auxiliary device for closing or swivelling the pin-and-socket coupler, is able to press over (slide along while exerting pressure on) the latching member.

This has the advantage that the auxiliary device can also be brought into an "assembling position", in which the outfitter can insert the contact elements of this connector into the connector, unhindered.

Thereupon, the auxiliary device is able to be returned again by pressing over the latching member.

In a locking position, on the other hand, the latching member is shifted in such a way that it forms an end stop for the auxiliary device, and guarantees its locking position.

DETAILED DESCRIPTION

Figure 1:
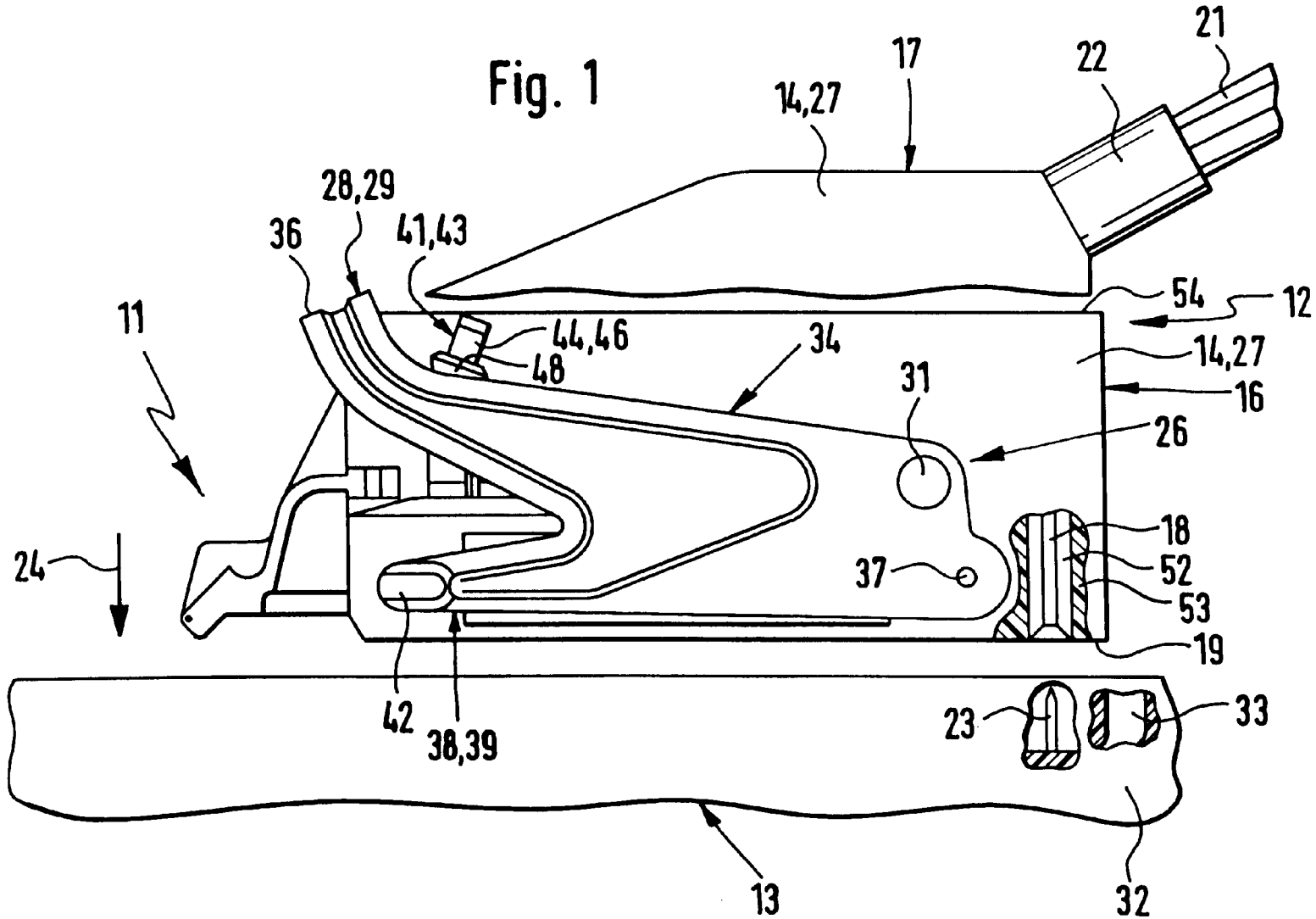
FIG. 1 shows a side view of the pin-and-socket coupler having two connectors.

An electric pin-and-socket coupler 11 according to FIG. 1 has a first connector 12 which is able to be releasably coupled to a second connector 13. First connector 12 is constructed as a movable wiring-harness plug, while second connector 13 is embodied as a plug receiver on the side of a device, for example, on a stationary control unit.

First connector 12 has a housing 14, constructed as a gripping piece from electrically insulating plastic, which includes a base 16 and a cover 17.

In first connector 12, a plurality of pin bushings, arranged in rows, are supported as first contact elements 18 in base 16 and are accessible from a plug-in side 19 of housing 14, which is open here, one of the pin bushings being shown schematically in FIG. 1.

First contact elements 18 are connected to conductor ends of a wiring harness 21 which, at one end wall 22, is brought out of desk-shaped cover 17 via a stub (connecting piece) 22 mounted on the face. First contact elements 18 are able to be coupled to second contact elements 23 of second connector 13, drawn schematically.

Second contact elements 23 are constructed as pin s and arranged in rows, allocated to first contact elements 18, so that a pair-wise connection of contact elements 18, 23 is effected when slipping first connector 12 on second connector 13 in a plug-in direction along an arrow 24 upon closing the pin-and-socket coupler. One of second contact elements 23 is shown schematically in FIG. 1.

To be able to easily overcome the plug-in and releasing forces, given the multitude of contact elements 18, 23, pin-and-socket coupler 11 is provided with an auxiliary device 26.

On one hand, auxiliary device 26 has a lever 28, rotationally mounted on side walls 27 of housing 14 in the area of base 16, having a manipulating part 29 and first guide elements 31, as well as second guide elements 33 installed on lateral surfaces 32 of second connector 13 and allocated to first guiding elements 31.

Lever 29 is U-shaped and has two side limbs 34, running parallel to each other, which are interconnected at one end by a crossbar 36. Side limbs 34 are led about swivel pins 37 secured to the housing, and run, with clearance of motion, on the outside along side walls 27 of housing 14.

Swivel pins 37, in the same way as the coulisse-like second guide elements 33, are mounted in central positions with respect to the series arrangement of contact elements 18, 23, and are symmetrically stressed by twisting moments, produced by the plug-in and releasing forces of contact elements 18, 23, when closing or opening pin-and-socket coupler 11.

The strip-shaped segments of side limbs 34, located between swivel pins 37 and crossbar 36, together with crossbar 36, form manipulating part 29, while the segments of side limbs 34, which are wider over a large surface than these segments, up to the free ends of side limbs 34, include first guide elements 31.

Each of side limbs 34 has a spring arm 38 running essentially parallel to allocated side wall 27, the spring arm, as part of a latching device 39 for retaining auxiliary device 26 in the closed position of pin-and-socket coupler 11, being capable of rebound travel transversely to side wall 27 and to the plug-in direction.

Spring arm 38 includes at its free end a spoon-shaped counter-latching means 42, in allocation to a latching member 41 arranged on side wall 27.

Latching member 41 is constructed as a lug, and is joined, using only one front-side interface connection 43, to side wall 47 in the area of base 16; like spring arm 38, latching member 41 is capable of rebound travel transversely to side wall 27 and to the plug-in direction.

Latching member 41, on one outer side 44, has a first latching element 46 in the area of interface connection 43, and a second latching element 47 at its free end. Formed between latching elements 46, 47 is a depression 48 for receiving counter-latching means 42.

In an initial position, free from deflection forces, latching member 41 is inclined in the plug-in direction toward side wall 27, and extends with its free end into housing 14.

Upon placing cover 17 on base 16, latching member 41 is grasped at one inner side 49 by a collar 51 of cover 17 plunging into base 16, and is forced, counter to its restoring force, with inner side 49 in alignment with respect to side wall 27.

Figure 2:
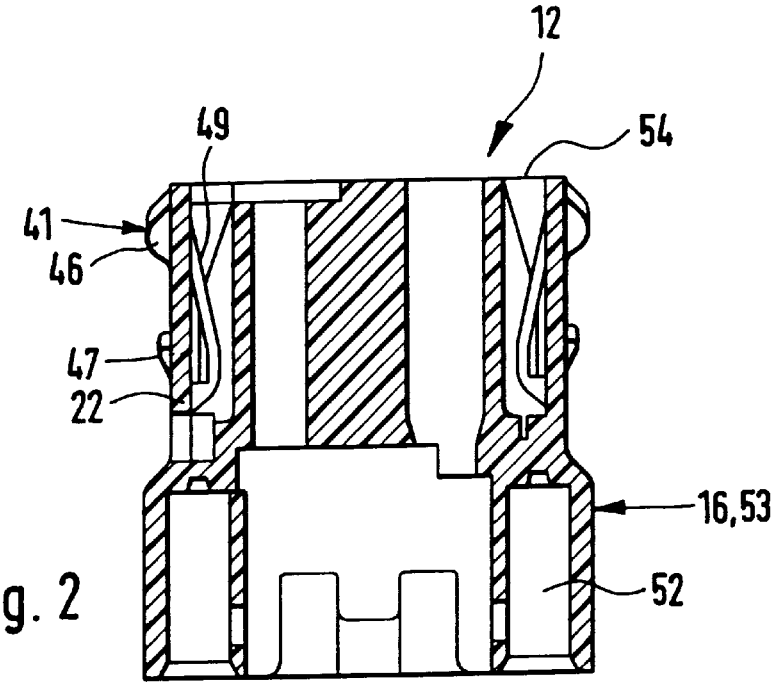
FIG. 2 shows a cross-section through a base of one of the two connectors.

Base 16 according to FIG. 2, separated from cover 17, is supplied at an outfitter for fitting first connector 12 with first contact elements 18. To facilitate accessibility to receiving chambers 52 for first contact elements 18 in a contact carrier 53 of base 16 from its top area 54 for efficient fitting of first contact elements 18, lever 28 is brought into an "assembling" position, as it occupies in FIG. 1.

After the insertion of first contact elements 18 into contact carrier 53 and their connection to the conductor ends of wiring harness 21, lever 28, starting from the representation according to FIG. 1, is swiveled clockwise by 90° to an open position, not shown, in which it is possible to couple the two connectors 12, 13 in the plug-in direction. During this swivelling action, counter-latching means 42 passes latching member 41, while spring arm 38, upon pressing over the two latching elements 46, 47, rebounds transversely to the plug-in direction.

As is clear from FIG. 2, first latching element 46 has a dome-shaped cross-sectional area, so that this first latching element 46 is easily able to be pressed over due to the rebound travel of spring arm 38.

Second latching element 47, which can be seen only indirectly in FIG. 2, since it is arranged at the free end of latching member 41 inclined into housing 14, does not significantly jut outwardly beyond side wall 22, so that this second latching element 47 is also able to be pressed over in this position of latching member 41 by counter-latching means 42.

Thus, given a separated base 16 according to FIG. 2, lever 28 can be reversibly swiveled between the assembling position and the open position, it being possible for counter-latching means 42 to press over the two latching elements 46, 47 in both directions.

Figure 3:
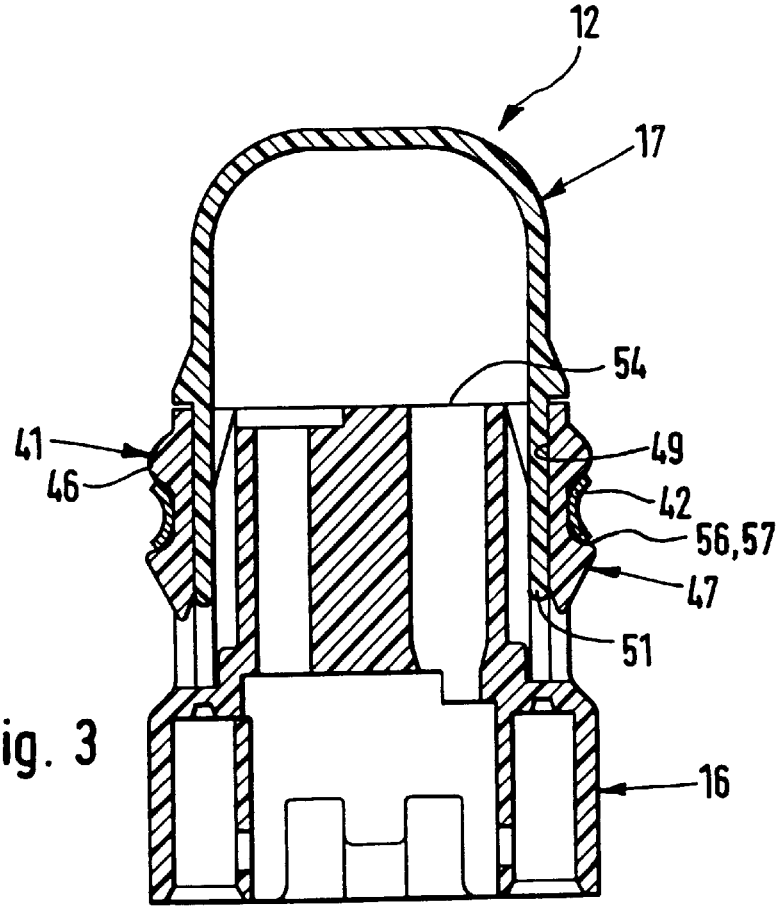
FIG. 3 shows a cross-section through a cover of one of the two connectors, the cover being placeable on the base.

Starting from a position of lever 28 in the area between latching member 41 and the open position, first connector 12 is completed by placing cover 17 on base 16 according to FIG. 3.

When cover 17 is placed on base 16 in the region of top area 54, collar 51, plunging into base 16, runs up against inner side 49 of latching member 41 and deflects it outwardly, predominantly at the free end. Thus, latching member 41 is forced into a locking position, and associated therewith is an outer displacement of second latching element 47 according to FIG. 3.

As a transition to depression 48, second latching element 47 has a flank 56 which runs transversely to the moving direction of lever 28. By placing cover 17 on base 16, this flank 56 is forced into the engagement area of counter-latching means 42 which, when swivelling into latching member 41, is still able to overcome first latching element 46 and arrive in depression 48, however, an end stop 57 which can no longer be overcome is disposed at flank 56.

Thus, latching member 41, which counter-latching means 42 must be able to press over to attain an assembling position, forms an end stop 57 for counterlatching means 42 after cover 17 is placed on base 16, which can be carried out in two opposed directions; thereby auxiliary device 26 with lever 28 is latched in the locking position, reversibly, in a manner that does not permit press-over action, to safeguard the closed position of pin-and-socket coupler 11.

What is claimed is:

1. An electric pin-and-socket coupler comprising:

a plug acting as a first connector;

a mating connector, acting as a second connector, for coupling to the first connector;

an auxiliary device for opening and closing the pin-and-socket coupler, the auxiliary device having a lever supported on one of the first and second connectors, the lever including a counter-latching element, the lever having a primary moving direction; and a latching device for latching the auxiliary device at least when the pin-and-socket coupler is closed, the latching device including, on one of the first and second connectors, at least one latching member, the at least one latching member having at least two latching elements extending transversely to the primary moving direction of the lever, the counter-latching element of the lever being assigned to the at least two latching elements, the counter-latching element pressing over the at least two latching elements in an initial position of the at least one latching member, at least one of the at least two latching elements forming an end stop for the counter-latching element after a displacement of the at least one latching member transversely to the primary moving direction of the lever into a locking position.

2. The electric pin-and-socket coupler according to claim 1, wherein:

the first connector includes a housing, the at least one latching member swivels transversely to the primary moving direction of the lever, a first of the at least two latching elements is situated at an interface to the housing, a second of the at least two latching elements is situated at a free end of the at least one latching member, and the at least one latching member, in an initial position in which the at least one latching member is free from outside forces, extends, at least with portions of the second latching element, into the housing.

3. The electric pin-and-socket coupler according to claim 2, wherein:

the housing includes a base and a cover, the base including the at least one latching member, the cover, when placed on the base, swiveling the at least one latching member with the second latching element against a restoring force of the at least one latching member into the locking position;

in the locking position, a flank, situated on the second latching element and extending at right angles with respect to the primary moving direction, comes into a grasping area of the counter-latching element, such that the flank forms the end stop for the counter-latching element.

* * * * *